United States Patent [19]

Champ et al.

[11] Patent Number: 4,490,452

[45] Date of Patent: Dec. 25, 1984

[54] XEROGRAPHIC PHOTOCONDUCTORS WITH CROSS-LINKED EPOXY BINDER

[75] Inventors: Robert B. Champ; Yau T. Chen, both of Boulder, Colo.

[73] Assignee: International Business Machines Corporation, Armonk, N.Y.

[21] Appl. No.: 560,063

[22] Filed: Dec. 9, 1983

[51] Int. Cl.[3] ..... G03G 5/06; G03G 5/14

[52] U.S. Cl. ..... 430/58; 430/59; 430/96

[58] Field of Search ..... 430/58, 59, 96

[56] References Cited

U.S. PATENT DOCUMENTS

| | | | |
|---|---|---|---|
| 4,053,311 | 10/1977 | Limburg et al. | 430/59 |
| 4,123,270 | 10/1978 | Heil et al. | 96/1.5 R |
| 4,330,608 | 5/1982 | Limburg et al. | 430/59 |
| 4,362,798 | 12/1982 | Anderson et al. | 430/59 |
| 4,397,931 | 8/1983 | Limburg et al. | 430/59 |

FOREIGN PATENT DOCUMENTS

| | | | |
|---|---|---|---|
| 14061 | 7/1980 | European Pat. Off. | 430/58 |
| 55-157748 | 12/1980 | Japan | 430/58 |
| 58-9148 | 1/1983 | Japan | 430/58 |
| 1022937 | 11/1963 | United Kingdom | 430/96 |

*Primary Examiner*—Roland E. Martin
*Attorney, Agent, or Firm*—Francis A. Sirr

[57] ABSTRACT

An aggregate-type xerographic photoconductor wherein primary or secondary amines are used not only to solubilize the photoconductor's light sensitive organic dye, but also to act as a cross-linker for an epoxy binder of the bisphenol class. A combined CTL/CGL layer is described, having both hole transport and charge generating dye molecules. The resulting layer is useful either as single-layer, bimodal photoconductor, or as the CGL of a two-layer photoconductor.

11 Claims, No Drawings

XEROGRAPHIC PHOTOCONDUCTORS WITH CROSS-LINKED EPOXY BINDER

DESCRIPTION

Field of the Invention

This invention relates to the field of organic xerographic or electrophotographic photoconductors of the type used in reproduction devices such as copiers and printers

BACKGROUND AND SUMMARY OF THE INVENTION

The prior art of organic xerographic photoconductors contains teachings that the dye molecule known as hydroxy squarylium (OHSQ) may be used as the charge generating (i.e., creating electron-hole pairs by absorption of photons) molecule of a charge generating layer (CGL); and that diphenylhydrazone (DEH) or 1-phenyl-3[p-diethylaminostyryl]-5-[p-diethylaminophenyl]-pyrazoline (DEASP) may be used as hole transporting molecules of a photoconductor's charge transport layer (CTL). U.S. Pat. No. 4,123,270 is exemplary of the former, while U.S. Pat. No. 4,362,798 is exemplary of the latter. In addition, the former of these two patents teaches the use of an amine to dissolve the dye molecule. Both of these patents are incorporated herein by reference.

The present invention relates to the use of constituents of this type, but to the use of such organic dye molecules in a single layer which has utility as the combined CGL/CTL of a single-layer photoconductor, or alternatively, may be used as the CGL of a two-layer photoconductor which has a separate CTL. In addition, whatever utility is chosen for this layer, the present invention teaches the use of a thermosetting epoxy resin (more specifically a bisphenol A epoxy) wherein the primary or secondary amine which is used to solubilize the dye of the present invention, also acts as the cross-linker for the epoxy resin. This results in a layer which is resistant to organic solvents, for example solvents which might be used to coat a CTL onto the aforesaid epoxy-containing layer while making a two-layer photoconductor.

THE INVENTION

The present invention provides a single layer, bimodal, photoconductor, in aggregate form, whose binder is an epoxy resin. While a separate CTL need not be provided, the aforesaid single layer can be used as the CGL of a two-layer photoconductor. Since the single layer is bimodal, that is, it responds to either positive or negative charge followed by illumination, it has utility in reproduction devices having either positive or negative charging sources.

A unique feature of the present invention is the selection of a dye solubilizing agent which also acts as the cross-linking agent of the selected binder resin. In this way, the solubilizing agent is very effectively eliminated from the final dry coating, since not only does the solubilizing agent evaporate during curing of the coating, but it is also bound to the binder as a cross-linker. The preferred binder is an epoxy, and more specifically bisphenol A epoxy, of which the brand EPON 1009 (Shell Chemical Co.) is preferred. EPON is a trademark for a series of condensation products of epichlorohydrin and bisphenol A. The amine dye solubilizer/cross-linker may be either a primary amine or a secondary amine. The primary amine ethylenediamine (EDA) is preferred.

In the following descriptions of eleven examples of the present invention (Examples A–K) all examples make use of the EPON brand of bisphenol A epoxy. In addition, all but Example G makes use of the solvent tetrahydrofuran (THF) to dissolve the epoxy, whereas Example G uses methylene chloride.

All examples make use of the hole transport molecule DEH.

Examples A–C and G–L make use of the primary amine ethylenediamine (EDA); while Example D makes use of the secondary amine piperidine; Example E makes use of the secondary amine pyrrolidine; and Example F makes use of diethylene triamine, a molecule which exhibits both primary and secondary amine functionality.

Examples B, C and G–K do not include the hole transport molecule DEASP (as do Examples A and D–F).

The two electron generating molecules used are OHSQ (Examples A, C–H and J); chlorodiane blue (CDB) (Examples B and I); and a combination of OHSQ and CDB (Example K).

Examples H–K are examples of two-layer photoconductors utilizing this invention.

EXAMPLE A

Twelve grams of EPON 1009 are dissolved in 50 cc of THF. To this solution is added 7 grams of the hole transport molecule DEH and 1 gram of the hole transport molecule DEASP. After the solution has achieved complete dissolution, 0.3 gram of the charge generating molecule OHSQ, which has previously been dissolved in 1.5 cc of EDA (to produce a straw color solution) is added to the solution. The result is a green solution. The solution is now coated to a thickness of about 15 microns, onto the aluminum surface of an aluminized Mylar substrate. The coated article is now cured for about one hour at 100° C. During this curing process, the coating undergoes a shift in its visible color, and in its spectral absorption, to the near infrared region of the spectrum. At this time, the epoxy is cross-linked with the EDA, and the coating is thereafter resistant to organic solvents, such as THF.

This layer exhibits sensitivity in both the positive-charging and the negative-charging modes.

Tests in the negative-charge mode, where the layer was charged to −600 VDC, gave a sensitivity of 3.4 microjoules per square cm at −150 VDC, at a dark decay of 83 volts/second, and with a residual potential of −126 VDC at 4.4 microjoules per square centimeter.

EXAMPLE B

Twelve grams of EPON 1007 are dissolved in 50 cc of THF. To this solution is added 8 grams of the hole transport molecule DEH. After the solution has achieved complete dissolution, 0.3 gram of the charge generating molecule CDB, which has previously been dissolved in 2.5 cc of EDA (to produce a blue solution) is added to the solution. The result is a blue solution. The solution is now coated to a thickness of about 20 microns, onto the aluminum surface of an aluminized Mylar substrate. The coated article is now cured for about one hour at 100° C. The epoxy is cross-linked with the EDA, and the coating is resistant to organic solvents, such as THF.

This layer exhibits sensitivity in both the positive-charging and the negative-charging modes.

Tests in the negative-charge mode, where the layer was charged to −550 VDC, gave a sensitivity of 2.7 microjoules per square cm at −150 VDC, at a dark decay of 20 volts/second, and with a residual potential of −99 VDC at 4.4 microjoules per square centimeter.

EXAMPLE C

Twelve grams of EPON 1007 are dissolved in 50 cc of THF. To this solution is added 8 grams of the hole transport molecule DEH. After the solution has achieved complete dissolution, 0.3 gram of the charge generating molecule OHSQ, which has previously been dissolved in 2.5 cc of EDA (to produce a straw color solution) is added to the solution. The result is a green solution. The solution is now coated to a thickness of about 10 microns, onto the aluminum surface of an aluminized Mylar substrate. The coated article is now cured for about one hour at 100° C. During this curing process, the coating undergoes a shift in its visible color, and in its spectral absorption, to the near infrared region of the spectrum. At this time, the epoxy is cross-linked with the EDA, and the coating is thereafter resistant to organic solvents, such as THF.

This layer exhibits sensitivity in both the positive-charging and the negative-charging modes. Tests in the negative-charge mode, where the layer was charged to −550 VDC, gave a sensitivity of 4.2 microjoules per square cm at −150 VDC, at a dark decay of 86 volts/-second, and with a residual potential of −150 VDC at 4.4 microjoules per square centimeter.

EXAMPLE D

Twelve grams of EPON 1009 are dissolved in 50 cc of THF. To this solution is added 7 grams of the hole transport molecule DEH and 1 gram of the hole transport molecule DEASP. After the solution has achieved complete dissolution, 0.2 gram of the charge generating molecule OHSQ, which has previously been dissolved in 4.0 cc of piperidine (to produce a straw color solution) is added to the solution. The result is a green solution. The solution is now coated to a thickness of about 15 microns, onto the aluminum surface of an aluminized Mylar substrate. The coated article is now cured for about one hour at 100° C. During this curing process, the coating undergoes a shift in its visible color, and in its spectral absorption, to the near infrared region of the spectrum. At this time, the epoxy is cross-linked with the EDA, and the coating is thereafter resistant to organic solvents, such as THF.

This layer exhibits sensitivity in both the positive-charging and the negative-charging modes.

Tests in the negative-charge mode, where the layer was charged to −600 VDC, gave a sensitivity of 5.3 microjoules per square cm at −150 VDC, at a dark decay of 14 volts/second.

EXAMPLE E

Six grams of EPON 1009 are dissolved in 25 cc of THF. To this solution is added 1.2 grams of the hole transport molecule DEH and 3 grams of the hole transport molecule DEASP. After the solution has achieved complete dissolution, 0.3 gram of the charge generating molecule OHSQ, which has previously been dissolved in 1.0 cc of pyrrolidine (to produce a straw color solution) is added to the solution. The result is a green solution. The solution is now coated to a thickness of about 15 microns, onto the aluminum surface of an aluminized Mylar substrate. The coated article is now cured for about one hour at 100° C. During this curing process, the coating undergoes a shift in its visible color, and in its spectral absorption, to the near infrared region of the spectrum. At this time, the epoxy is cross-linked with the EDA, and the coating is thereafter resistant to organic solvents, such as THF.

This layer exhibits sensitivity in both the positive-charging and the negative-charging modes.

Tests in the negative-charge mode, where the layer was charged to −650 VDC, gave a sensitivity of 2.4 microjoules per square cm at −150 VDC, at a dark decay of 59 volts/second, and with a residual potential of −79 VDC at 4.4 microjoules per square centimeter.

EXAMPLE F

Five grams of EPON 1009 are dissolved in 25 cc of THF. To this solution is added 1.0 gram of the hole transport molecule DEH and 2.5 grams of the hole transport molecule DEASP. After the solution has achieved complete dissolution, 0.3 gram of the charge generating molecule OHSQ, which has previously been dissolved in 1.0 cc of diethylene triamine (to produce a straw color solution) is added to the solution. The result is a green solution. The solution is now coated to a thickness of about 15 microns, onto the aluminum surface of an aluminized Mylar substrate. The coated article is now cured for about one hour at 100° C. During this curing process, the coating undergoes a shift in its visible color, and in its spectral absorption, to the near infrared region of the spectrum. At this time, the epoxy is cross-linked with the EDA, and the coating is thereafter resistant to organic solvents, such as THF.

This layer exhibits sensitivity in both the positive-charging and the negative-charging modes.

Tests in the negative-charge mode, where the layer was charged to −600 VDC, gave a sensitivity of 4.9 microjoules per square cm at −150 VDC, at a dark decay of 47 volts/second.

EXAMPLE G

Six grams of EPON 1009 are dissolved in 25 cc of methylene chloride. To this solution is added 4 grams of the hole transport molecule DEH. After the solution has achieved complete dissolution, 0.3 gram of the charge generating molecule OHSQ, which has previously been dissolved in 1.5 cc of EDA (to produce a straw color solution) is added to the solution. The result is a green solution, with some crystallization. The mixture is now coated to a thickness of about 20 microns, onto the aluminum surface of an aluminized Mylar substrate. The coated article is now cured for about two hours at 100° C. During this curing process, the coating undergoes a shift in its visible color, and in its spectral absorption, to the near infrared region of the spectrum. At this time, the epoxy is cross-linked with the EDA, and the coating is thereafter resistant to organic solvents, such as THF.

This layer exhibits sensitivity in both the positive-charging and the negative-charging modes.

Tests in the negative-charge mode, where the layer was charged to −600 VDC, gave a sensitivity of 1.5 microjoules per square cm at −150 VDC, at a dark decay of 48 volts/second, and with a residual potential of −63 VDC at 4.4 microjoules per square centimeter.

EXAMPLE H 1.5 grams of EPON 1009 are dissolved in 25 cc of THF. To this solution is added 1.0 gram of the hole transport molecule DEH. After the solution has achieved complete dissolution, 0.3 gram of the charge generating molecule OHSQ, which has previously been dissolved in 1.0 cc of EDA (to produce a straw color solution) is added to the solution. The result is a green solution. The solution is now coated to a thickness of about 1.5 microns, onto the aluminum surface of an aluminized Mylar substrate, to form the charge generating layer of a two-layer photoconductor. The coated article is now cured for about one hour at 100° C. During this curing process, the coating undergoes a shift in its visible color, and in its spectral absorption, to the near infrared region of the spectrum. At this time, the epoxy is cross-linked with the EDA, and the coating is thereafter resistant to organic solvents, such as THF.

A hole transport layer is now coated onto the aforesaid charge generating layer. This transport layer is coated from a solution of 10 grams of the brand MERLON 60 polycarbonate (Mobay Chemical Company), 0.5 gram of the brand VITEL PE-200 polyester (Goodyear Tire & Rubber Co.), and 8 grams of the hole transport molecule DEASP which has been dissolved in 100 cc of THF. This coating is about 0.0015 cm thick, after curing about one hour at 100° C.

This two-layer photoconductor exhibits sensitivity in only the negative-charging mode.

Tests in the negative-charge mode, where the layer was charged to −600 VDC, gave a sensitivity of 1.25 microjoules per square cm at −150 VDC, at a dark decay of 58 volts/second, and with a residual potential of −84 VDC at 4.4 microjoules per square centimeter. The quantum yield of this photoconductor ($\eta$ electrons negated $\div \eta$ photons absorbed) is 0.3 at $2 \times 10^5$ volts/cm at 820 nm.

EXAMPLE I

One gram of EPON 1009 are dissolved in 25 cc of THF. To this solution is added 0.67 gram of the hole transport molecule DEH. After the solution has achieved complete dissolution, 0.2 gram of the charge generating molecule CDB, which has previously been dissolved in 2.5 cc of EDA (to produce a blue solution) is added to the solution. The solution is now coated to a thickness of about 2.0 microns, onto the aluminum surface of an aluminized Mylar substrate, to form the charge generating layer of a two-layer photoconductor. The coated article is now cured for about one hour at 100° C. At this time, the epoxy is cross-linked with the EDA, and the coating is thereafter resistant to organic solvents, such as THF.

A hole transport layer is now coated onto the aforesaid charge generating layer. This transport layer is coated from a solution of 11 grams of the brand MERLON 60 polycarbonate (Mobay Chemical Company), 1.0 gram of the brand VITEL PE-200 polyester (Goodyear Tire & Rubber Co.), and 8 grams of the hole transport molecule DEASP which has been dissolved in 100 cc of THF. This coating is about 0.002 cm thick, after curing about one hour at 100° C.

This two layer photoconductor exhibits sensitivity in the negative-charging mode.

Tests in the negative-charge mode, where the layer was charged to −650 VDC, gave a sensitivity of 2.1 microjoules per square cm at −150 VDC, at a dark decay of 21 volts/second, and with a residual potential of −88 VDC at 4.4 microjoules per square centimeter.

EXAMPLE J 1.2 grams of EPON 1009 are dissolved in 20 cc of THF. To this solution is added 0.8 gram of the hole transport molecule DEH. After the solution has achieved complete dissolution, 0.2 gram of the generating molecule CDB, which has previously been dissolved in 5.0 cc of EDA (to produce a blue solution) is added to the solution. The solution is now coated to a thickness of about 1.5 microns, onto the aluminum surface of an aluminized Mylar substrate to form the charge generating layer of a two-layer photoconductor. The coated article is now cured for about one hour at 100° C. At this time, the epoxy is cross-linked with the EDA, and the coating is thereafter resistant to organic solvents, such as THF.

A hole transport layer is now coated onto the aforesaid charge generating layer. This transport layer is coated from a solution of 55 parts of the brand MERLON 60 polycarbonate (Mobay Chemical Company), 5 parts of the brand VITEL PE-200 polyester (Goodyear Tire & Rubber Co.), and 40 parts of the hole transport molecule DEH. This coating is about 18 microns thick, after curing about one hour at 100° C.

This two-layer photoconductor exhibits sensitivity in the negative-charging mode.

Tests in the negative-charge mode, where the layer was charged to −820 VDC, gave a sensitivity of 2.1 microjoules per square cm at −150 VDC, with a standard deviation of 0.2 and with a residual potential of −28 VDC at 4.4 microjoules per square centimeter, with a standard deviation of 6.0. The number of trials was 36.

EXAMPLE K 1.2 grams of EPON 1009 are dissolved in 20 cc of THF. To this solution is added 0.8 gram of the hole transport molecule DEH. After the solution has achieved complete dissolution, 0.15 gram of the charge generating molecule CDB and 0.10 gram of the charge generating molecule OHSQ, which has previously been dissolved in 2.5 cc of EDA (to produce a blue solution) is added to the solution. The solution is now coated to a thickness of about 2 microns, onto the aluminum surface of an aluminized Mylar substrate to form the charge generating layer of a two-layer photoconductor. The coated article is now cured for about one hour at 100° C. During this curing process, the coating undergoes a shift in its visible color, and in its spectral absorption, to the near infrared region of the spectrum. At this time, the epoxy is cross-linked with the EDA, and the coating is thereafter resistant to organic solvents, such as THF.

A hole transport layer is now coated onto the aforesaid charge generating layer. This transport layer is coated from a solution of 55 parts of the brand MERLON 60 polycarbonate (Mobay Chemical Company), 5 parts of the brand VITEL PE-200 polyester (Goodyear Tire & Rubber Co.), and 40 parts of the hole transport molecule DEH. This coating is about 18 microns thick, after curing about one hour at 100° C.

This two-layer photoconductor exhibits sensitivity in the negative-charging mode.

Tests in the negative-charge mode, where the layer was charged to −600 VDC, gave a sensitivity of 2.4 microjoules per square cm at −150 VDC, at a dark decay of 76 volts/second, and with a residual potential of −104 VDC at 4.4 microjoules per square centimeter.

While the invention has been particularly shown and described with reference to preferred embodiments thereof, it will be understood by those skilled in the art that various changes in form and details may be made therein without departing from the spirit and scope of the invention.

What is claimed is:

1. A combined charge generating and charge transporting photosensitive layer, comprising:

a cross-linked epoxy resin binder;

at least one transport molecule; and a charge generating molecule solubilized in an amine, which amine also acts to cross-link said epoxy.

2. The photosensitive layer of claim 1 wherein said epoxy is a bisphenol A epoxy, and wherein said amine is a primary amine.

3. The photosensitive layer of claim 2 wherein said charge generating molecule is hydroxysquarylium or Chloro Diane Blue, and said primary amine is ethylenediamine.

4. The photosensitive layer of claim 3 wherein said hole transport molecule is diphenylhydrazone or 1-phenyl-3[p-diethylaminostyryl]-5-[p-diethylamino-phenyl]-pyrazoline.

5. The photosensitive layer of claim 4 including both diphenylhydrazone and 1-phenyl-3[p-diethylaminostyryl]-5-[p-diethyl-aminophenyl]-pyrazoline

6. The photosensitive layer of claim 5 including both hydroxysquarylium Chloro Diane Blue.

7. The photosensitive layer of claim 1 wherein said epoxy is a bisphenol A epoxy, and wherein said amine is a secondary amine.

8. The photosensitive layer of claim 7 wherein said secondary amine is piperidine.

9. The photosensitive layer of claim 1 wherein said amine is ethylenediamine, piperidine, diethylene triamine or pyrrolidine.

10. An electrophotographic photoconductor whose charge generation layer comprises the layer of claim 1, and wherein a charge transfer layer is coated on the surface of the layer of claim 1.

11. An electrophotographic photoconductor whose charge generation layer comprises the layer of claim 3, and wherein a charge transfer layer is coated on the surface of the layer of claim 3.

* * * * *